US010584873B1

(12) United States Patent
Bacon

(10) Patent No.: US 10,584,873 B1
(45) Date of Patent: Mar. 10, 2020

(54) FLARE GAS ASSEMBLY

(71) Applicant: David Bacon, Bastrop, TX (US)

(72) Inventor: David Bacon, Bastrop, TX (US)

( * ) Notice: Subject to any disclaimer, the term of this patent is extended or adjusted under 35 U.S.C. 154(b) by 221 days.

(21) Appl. No.: 15/587,960

(22) Filed: May 5, 2017

Related U.S. Application Data

(60) Provisional application No. 62/403,301, filed on Oct. 3, 2016, provisional application No. 62/332,811, filed on May 6, 2016.

(51) Int. Cl.
*F23C 7/00* (2006.01)
*F23G 7/08* (2006.01)

(52) U.S. Cl.
CPC ..... *F23G 7/085* (2013.01); *F23G 2209/14* (2013.01)

(58) Field of Classification Search
CPC ..... F23G 2209/14; F23G 7/085
USPC ..... 431/182, 202, 264, 5
See application file for complete search history.

(56) References Cited

U.S. PATENT DOCUMENTS

| | | | | |
|---|---|---|---|---|
| 4,373,902 | A * | 2/1983 | Reed | F23G 7/085 431/202 |
| 5,429,496 | A * | 7/1995 | Stephens | F23G 7/085 431/202 |
| 6,146,131 | A * | 11/2000 | Wiseman | F23C 5/02 431/154 |
| 2006/0121399 | A1* | 6/2006 | Mashhour | F23G 7/08 431/202 |
| 2010/0291492 | A1* | 11/2010 | Poe | F23G 7/085 431/5 |
| 2015/0027373 | A1* | 1/2015 | Voronin | B01D 53/32 118/723 R |
| 2015/0050603 | A1* | 2/2015 | Griffin | F23G 7/085 431/5 |

* cited by examiner

*Primary Examiner* — Avinash A Savani
(74) *Attorney, Agent, or Firm* — Bushman Werner P.C.

(57) ABSTRACT

A flare gas assembly having an air pipe with an upper open end and a conduit in surrounding relationship to the air pipe. The conduit has a conduit upper end which extends above the upper open end of the air pipe, thereby forming a mixing chamber above the conduit's upper end and the upper end of the air pipe. A blower is connected to the air pipe to provide air for combustion purposes.

24 Claims, 5 Drawing Sheets

FLARE GAS ASSEMBLY

CROSS REFERENCE TO RELATED APPLICATION

This application claims priority to U.S. Application No. 62/403,301 filed on Oct. 3, 2016, and U.S. Application No. 62/332,811, filed May 6, 2016 the disclosures of which are incorporated herein by reference for all purposes.

FIELD OF THE INVENTION

The present invention relates to flares for burning waste gas and, more particularly, to a flare gas assembly for burning first and second flare gases, e.g., high pressure and low pressure flare gases.

BACKGROUND OF THE INVENTION

At oil and gas well sites, particularly where drilling is conducted in shale formations, there is an array of equipment, as for example tank batteries to collect crude oil and/or distillates from the oil and gas wells, as well as separators to separate gas/water from hydrocarbons. Generally speaking, tank batteries are a source of low pressure flare gas while separators are a source of high pressure flare gas. In either event, the gases cannot be allowed to accumulate as the pressure build up could create hazards to humans as well as potential damage to equipment. Nor can they be vented to atmosphere for environmental reasons. To alleviate this problem, these gases, both high and low pressure, are vented from the equipment and flared using a suitable flare gas assembly.

Low pressure gases from tank batteries, i.e., tanks that hold product (oil) for truck loading, present a challenge. Generally speaking, tank batteries are at atmospheric pressure and venting allows the product to easily flow in and out. However, the low pressure gas vented cannot be allowed to escape to the atmosphere least environmental regulations be violated. From a practical perspective, the only way to prevent these low pressure hydrocarbon emissions from escaping to the atmosphere is by flaring.

A typical tank battery is equipped with relief valves, such as Kimray valves well known to those skilled in the art, which relieve pressure from the tank when it exceeds about 4 to 5 ounces, although the relief valve can be set to vent at higher pressures, e.g., 10 ounces. The gas relieved from the pressure relief valve must, as discussed above, be flared. Flaring of low pressure tank battery gas can pose a problem not encountered in flaring of high pressure flare gas. High pressure gases generally have sufficient kinetic energy and do not require assist to burn smokelessly. However, because of its low pressure and insufficient kinetic energy, vented gas from tank batteries is normally flared using air assist flares. Typically, the air assist comes from a centrifugal or axial blower mounted at the bottom or side of the flare stack and a typical prior art flare handling low pressure tank batter emissions may have two 150 horsepower air blowers.

It is known that a properly operated low pressure air flare can achieve well over 98% destruction and removal efficiency (DRE) wherein DRE is the percent removal of hydrocarbon from the flare vent gas, provided that the air/hydrocarbon ratio is kept within a certain range. Thus, too much air can blow out the flame creating hydrocarbon emission detectible on Fourier Transfer Infrared (FTIR) cameras. In an attempt to overcome this problem, and maintain the air/hydrocarbon ratio in the desired range, prior art air flares handling low pressure flare gas, e.g., from tank batteries, typically employ blowers driven by electric motors with variable frequency (or variable speed) drives (VFD). These set ups also require additional, expensive equipment such as flow meters and process controllers, e.g., programmable logic controllers (PLCs) for efficient operation.

SUMMARY OF THE INVENTION

In one aspect, the present invention relates to a flare gas assembly for burning first and second flare gases.

In yet another aspect, the present invention relates to a flare gas assembly which can flare first and second gases, and wherein the first and second gases may be low pressure gases, high pressure gases, or one of the gases can be high pressure and the other low pressure.

In another aspect, the present invention relates to a flare gas assembly for flaring low pressure hydrocarbons wherein one or more blowers operated at constant speed(s) can provide virtually complete combustion of low pressure flare gas.

In still another aspect, the present invention relates to a flare gas assembly wherein the degree of combustion of entrained hydrocarbons in the flare gas(es) is substantially irrespective of the pressures/flow rates of the flare gas(es).

In still a further aspect, the present invention relates to a flare gas assembly wherein both high pressure and low pressure flare gas can be virtually completely combusted using a combustion air blower system operated at a single, desired speed to provide a constant desired flow rate of combustion air. In a further aspect, the present invention relates to a method of operating a flare gas assembly which can handle high and low pressure flare gases and wherein the low pressure gases can be combusted to a destruction and removal efficiency of hydrocarbons of greater than 98%.

These and further features and advantages of the present invention will become apparent from the following detailed description, wherein reference is made to the figures in the accompanying drawings.

DETAILED DESCRIPTION OF PREFERRED EMBODIMENTS

Figure 1:
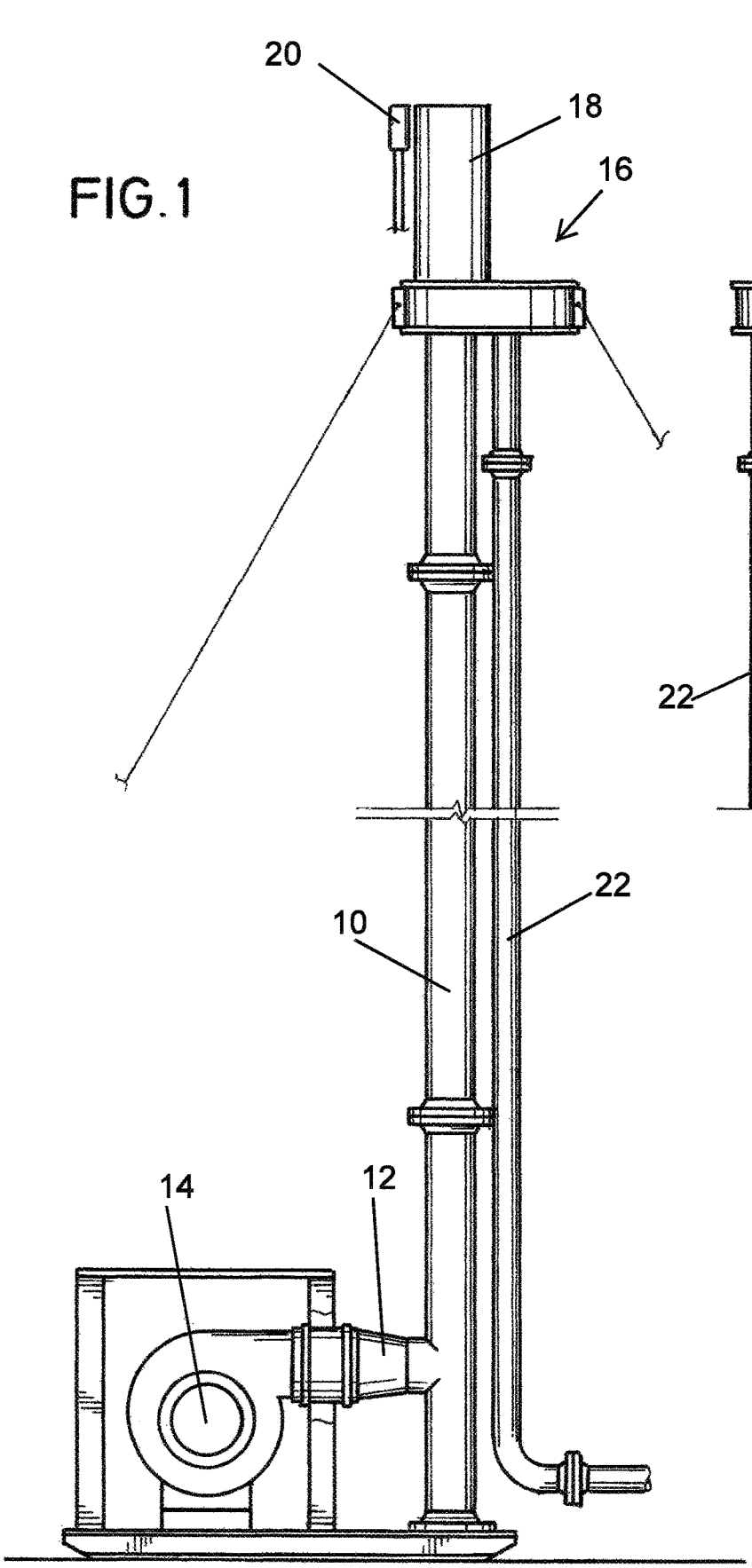
FIG. 1 is an elevational view of one embodiment of the flare gas assembly of the present invention.

Referring first to FIG. 1, there is an air stack or pipe 10 connected by piping 12 to a forced air blower 14. The air stack 10 which can be from about 20 to about 100 ft in length, is connected to a plenum assembly shown generally as 16 and described more fully hereafter. A flare pipe assembly 18 is connected to plenum assembly 16, flare pipe assembly 18 being adjacent a typical igniter 20.

Figure 2:
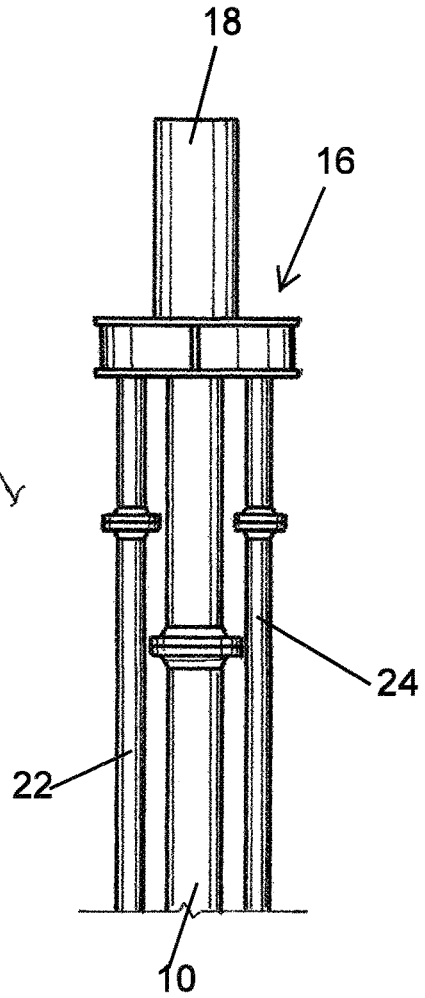
FIG. 2 is a partial elevational view of the flare gas assembly shown in FIG. 1 rotated 90° degrees.
Figure 4:
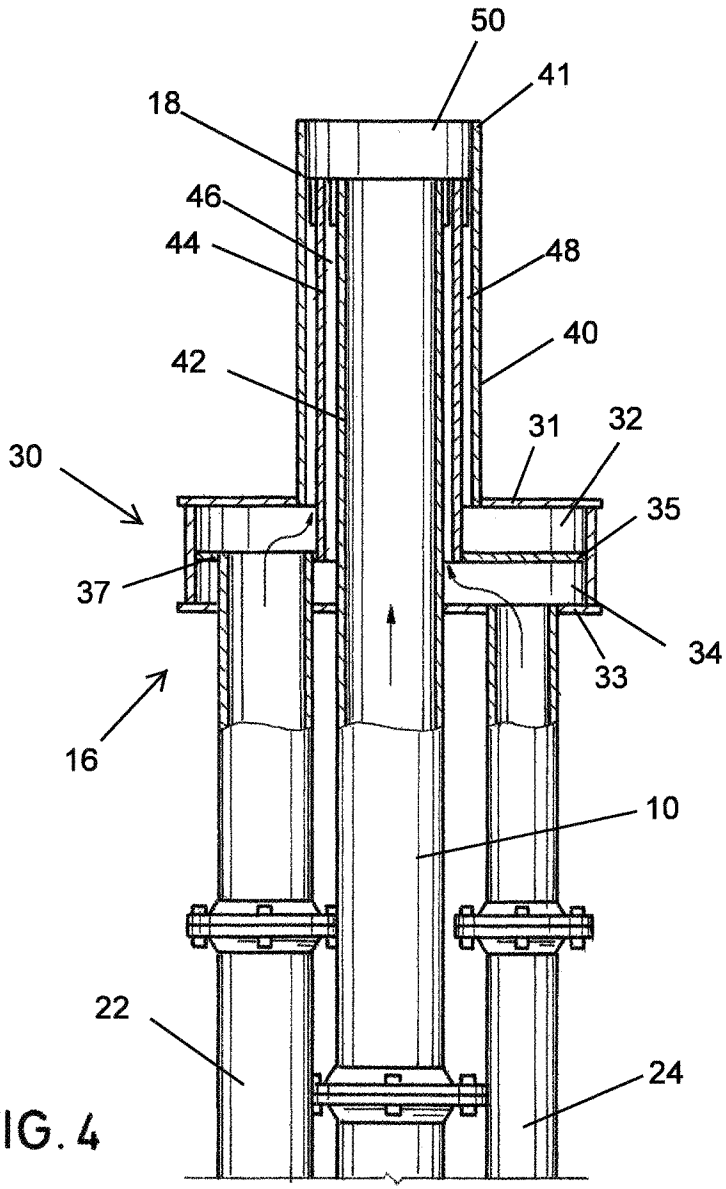
FIG. 4 is an elevational view, partly in section taken along the lines 4-4 of FIG. 3.

With reference to FIG. 2, a high pressure flare gas conduit 22 and a low pressure flare gas conduit 24 are connected to plenum assembly 16. Referring now to FIG. 4, it can be seen that plenum assembly 16 comprises a generally cylindrical housing shown generally as 30 in which is formed a high pressure flare gas plenum 32 and a low pressure flare gas plenum 34.

Figure 3:
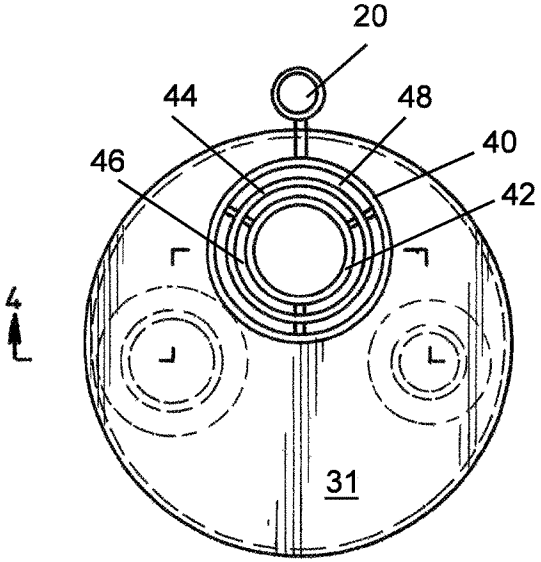
FIG. 3 is a top plan view of the flare gas assembly shown in FIG. 1.

Housing 30 as shown in FIG. 3, is generally circular when viewed in plan view. Housing 30 is comprised of a first or upper plate 31, a second or lower plate 33, and an intermediate plate 35, plates 31, 33, and 35 being connected to a peripheral wall 37 to form a generally cylindrical housing. As best seen in FIG. 4, first plenum 32 is formed by first plate 31, intermediate plate 35, and a part of peripheral wall 37, while second plenum 34 is formed by second plate 33, intermediate plate 35, and a part of peripheral wall 37. Again, as seen in FIG. 4, flare gas conduit 22 is connected to intermediate plate 35, and opens into plenum 32 while flare gas conduit 24 is connected to second plate 33 and opens into plenum 34.

While as described above, plenum housing 30 is generally cylindrical, it will be understood that it can take many shapes, e.g., rectangular, octagonal, etc.

As can be seen with reference to FIGS. 3 and 4, flare pipe assembly 18 comprises an outermost cylindrical pipe 40, an innermost cylindrical pipe 42 and an intermediate cylindrical pipe 44 which cooperate to form an inner annular flow path 46 and an outer annular flow path 48. As can be seen, the upper, terminal end 41 of outermost pipe 40 extends above the terminal ends of pipes 42 and 44 thereby forming a mixing chamber 50 above the upper terminal ends of pipes 42 and 44. Generally speaking in all the embodiments of the present invention, the distance between the upper terminal end 41 of the outermost pipe will be from about 2 to about 8 inches above the highest of the radially inner pipes, e.g., pipes 42 and 44. In a preferred case, the upper terminal end of pipes, e.g. 42 and 44 are coterminous.

In operation, air is forced upwardly through pipe 10 by means of blower 14 and exits into mixing chamber 50. High pressure gas from pipe 22 flows into plenum 32 and exits plenum 32 through outer annular flow path 48 into mixing chamber 50. Low pressure flare gas flows from pipe 24 into low pressure plenum 34 and exits through annular flow path 46 into mixing chamber 50. It can thus be seen that high pressure flare gas, low pressure flare gas, and air enter mixing chamber 50 and mix, the mixture being ignited by igniter 20.

While as shown in the embodiment of the invention depicted in FIGS. 1-4, the sources of high pressure and low pressure flare gases are introduced into the bottom of the plenum housing 30, it will be understood that the invention is not so limited. For example, gas conduit 22 could be connected to the peripheral wall 37 of plenum housing 30 such that the gas was introduced directly into plenum 32 and a like situation could avail with respect to gas conduit 24. A feature of the flare gas assembly of the present invention is that the blower 14 can be operated at a single speed, e.g., a constant flow rate of from about 1,000 to about 10,000 CFM, and will effectively and efficiently combine with the flare gas(es) from annuli 46 and 48 in mixing chamber 50 resulting in an almost ideal smokeless flare. This occurs regardless of whether the high and low pressure flare gases are being vented individually or simultaneously, and is independent of their relative flow rates and pressures.

Figure 5:
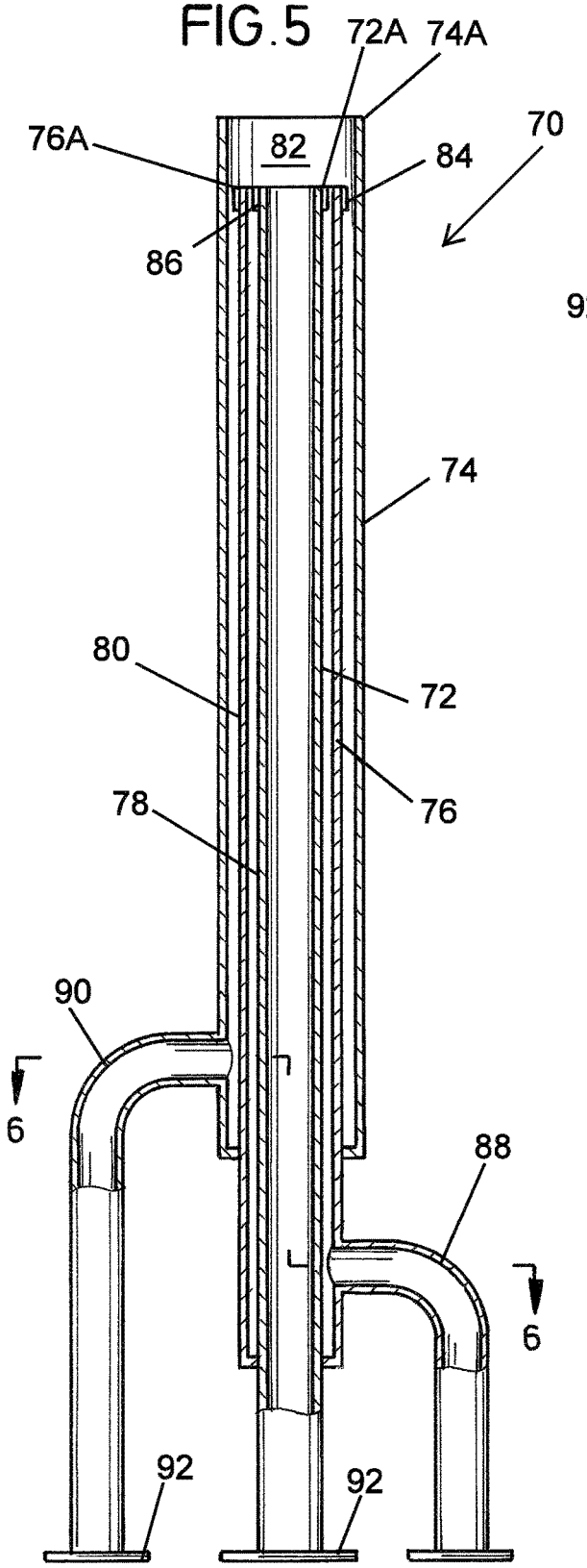
FIG. 5 is an elevation view, partly in section of another embodiment of the flare gas assembly of the present invention.
Figure 6:
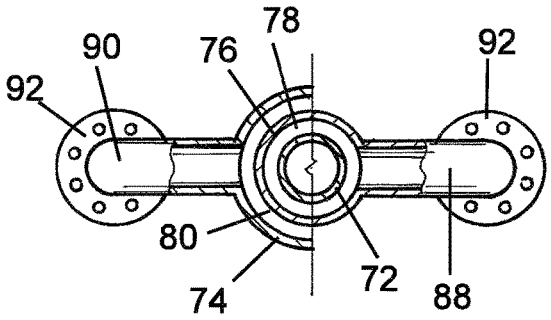
FIG. 6 is a view taken along the lines 6-6 of FIG. 5.

Referring now to FIGS. 5 and 6, there is shown another embodiment of the present invention. The flare stack assembly in FIG. 5 shown generally as 70 comprises an inner air stack or pipe 72, an outermost pipe, stack or conduit 74, and an intermediate pipe or stack 76. A first annulus 78 is formed between pipes 72 and 76 while a second annulus 80 is formed between outer pipe 74 and intermediate pipe 76. Pipe 74 has an upper end 74A while radially inward pipes 72 and 76 have upper ends 72A and 76A respectively. As seen, the upper end 74A of outer pipe 74 is above the upper ends 72A and 76A thereby forming a mixing chamber 82 above the upper ends 72A and 76A but below upper end 74A. As noted above, while the upper ends 72A and 76A are shown as being coterminous, such is not necessary, the only provision being that upper end 74A is above both upper ends 72A and 76A.

To maintain concentricity of concentric pipes at their upper ends, a series of radial tabs 84 extend between pipes 74 and 76 generally at 120° spacing while a similar set of tabs 86 extend between pipes 72 and 76, again being spaced at approximately 120°.

Forced air is fed to inner or air pipe 72 via a blower as described above with respect to the embodiment of FIG. 1. A pipe 88 connected to pipe 76 provides a flow path for a source of low pressure gas while a second pipe 90 connected to outer pipe 74 provides a conduit for a source of high pressure flare gas. As is typical, pipes 88 and 90 are flanged with flanges 92 for connection as needed.

Figure 7:
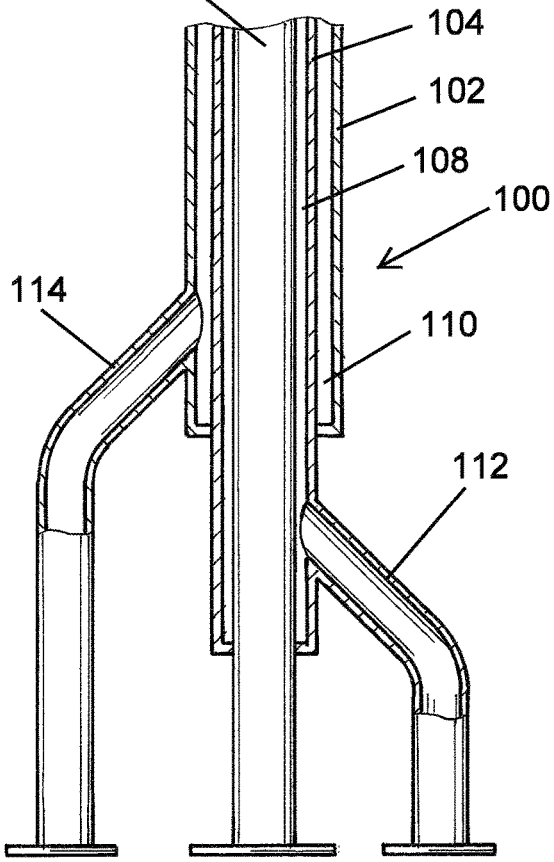
FIG. 7 is an elevational view of another embodiment of the present invention.

Referring now to FIG. 7 there is shown another embodiment of the present invention. The flare stack assembly of FIG. 7, shown generally as 100, comprises three generally concentric pipes or stacks 102, 104, and 106, pipe 104 being intermediate between pipes 102 and 106. As in the case of the other embodiments, air flows through pipes 106 while low pressure gas flows through the annulus 108 between innermost pipe 106 and radially intermediate pipe 104, and high pressure flare gas flows through the annulus 110 between the outermost pipe 102 and intermediate pipe 104.

The embodiment of FIG. 7 differs from that in FIGS. 5 and 6 in the fact that, whereas in the embodiment of FIG. 5, low and high pressure flare gases are introduced via piping 88 and 90, respectively, into annuli 78 and 80, respectively, generally at right angles, in the embodiment of FIG. 7, low pressure gas enters annulus 108 through angled pipe 112, while high pressure flare gas enters annulus 110 through angled pipe 114. In other words, in the embodiment of FIG. 7, the gas flows have both a radial and vertical vector component. Generally speaking, the angled portions of pipes 112 and 114 will be at an angle of from about 30° to 60° relative to a long axis passing concentrically through pipes 102, 104, and 106.

Figure 8:
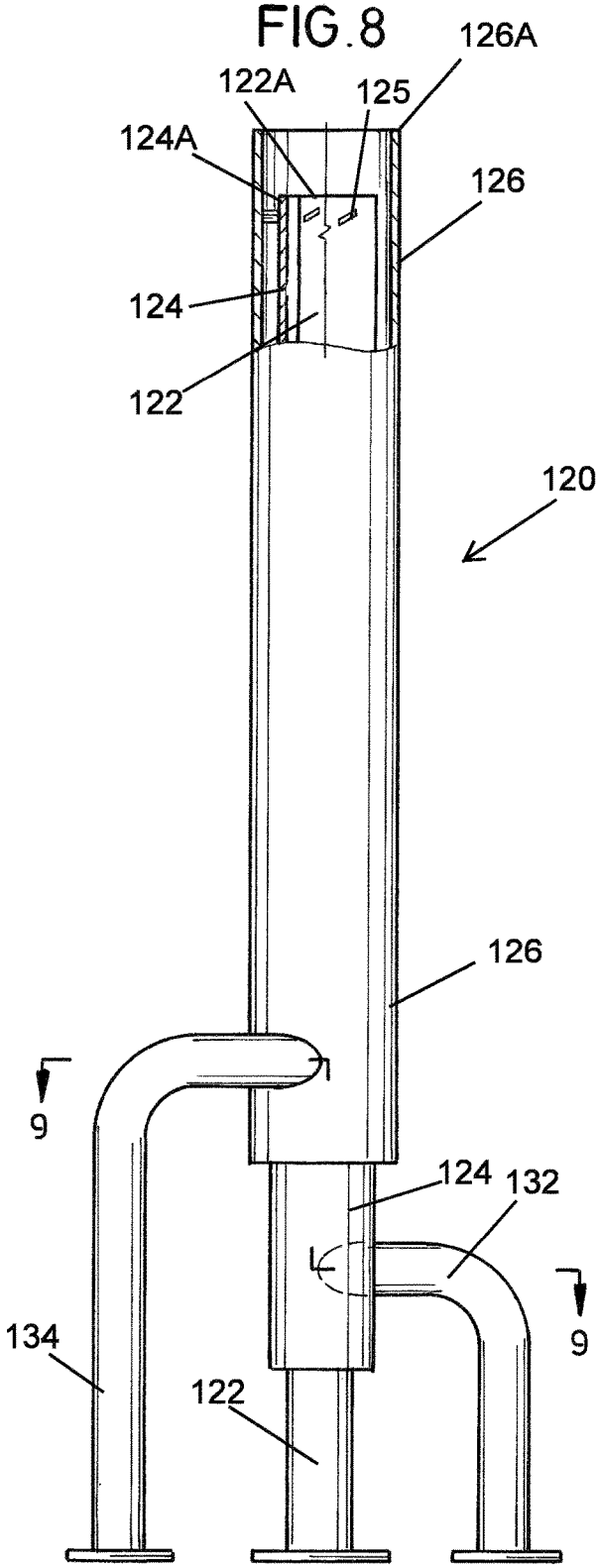
FIG. 8 is an elevational view of still a further embodiment of the present invention.
Figure 9:
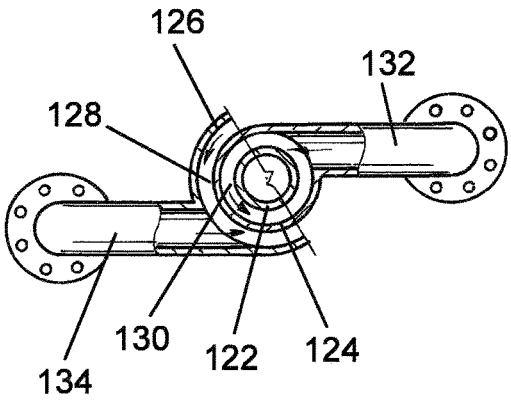
FIG. 9 is cross-sectional view taken along the lines 9-9 of FIG. 8.

Referring now to FIGS. 8 and 9, there is shown another embodiment of the present invention. The flare stack assembly of FIG. 8, shown generally as 120 again comprises three concentric generally vertically extending pipes comprised of innermost pipe 122, intermediate pipe 124, and radially outermost pipe 126. The pipes have respective upper ends 122A, 124A, and 126A, the upper ends 124A and 122A being below the upper end 126A. As best seen in FIG. 9, a high pressure annulus 128 is formed between outer pipe 126 and intermediate pipe 124, and a low pressure gas annulus 130 is formed between innermost air pipe 122 and radially intermediate pipe 124.

Low pressure flare gas is introduced into annulus 130 via feed pipe 132 which is offset from the centerline of annulus 130, e.g., generally tangential to pipe 124. Accordingly, low pressure gas entering annulus 130 is introduced in a swirling pattern as indicated by the arrows in FIG. 9. In like fashion, high pressure gas is introduced tangentially into annulus 128 via pipe 134.

Figure 10:
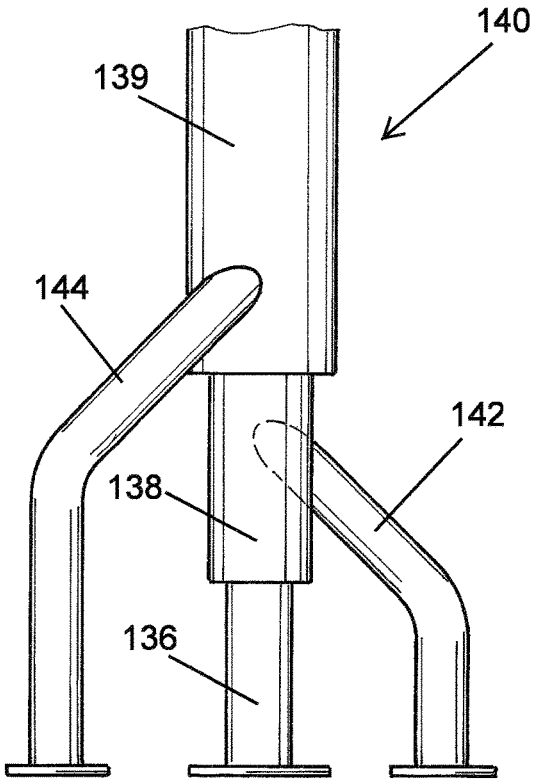
FIG. 10 is an elevational view of a further embodiment of the present invention.

Turning now to FIG. 10 there is shown yet another embodiment of the present invention. The flare gas assembly of FIG. 10, shown generally as 140, as in all the previous embodiments described above, comprises three preferably concentric pipes having relative elevation and disposition to one another at their upper ends as described above with respect to earlier embodiments, i.e., the upper end of the radially outermost pipe is above the upper ends of the radially inner pipes. The embodiment of FIG. 10 differs in that low pressure flare gas is introduced into the low pressure flare gas annulus by a pipe 142 which is connected both at an angle and tangentially to pipe 138 while high pressure gas is introduced into the high pressure flare gas annulus by pipe 144 which is connected both at an angle and tangentially to pipe 139. Basically, in the embodiment shown in FIG. 10, the high pressure and low pressure gases are introduced into the respective plenums via a combination of the piping arrangements shown in FIGS. 7, 8, and 9. This arrangement imparts both an upward and swirling motion to the gases as they are introduced into the respective plenums. Further, spacer tabs 125 between the respective pipes can be angled, as shown, to impart spin to air/gases exiting from the air pipe and the annuli between the pipes. If desired, the tabs could be shaped as spiral vanes to generate a helical motion in the exiting air/gas. In all other respects, the embodiment of FIG. 10 is as described above with respect to the other embodiments.

The piping arrangement used in the embodiments in FIGS. 8 and 9 to introduce the high and low pressure flare gases to the system can also be employed with respect to the embodiments shown in FIGS. 1-4. Thus, rather than having high pressure gas flow from pipe 22 into plenum 32, while low pressure flare gas flows into plenum 34 from pipe 24 in directions shown in FIGS. 1-4, pipes 22 and 24 could be connected to the sides and/or bottom walls of plenums 32 and 34, respectively, in a manner such that gas flow into the plenums has a tangential/helical pattern.

Figure 12:
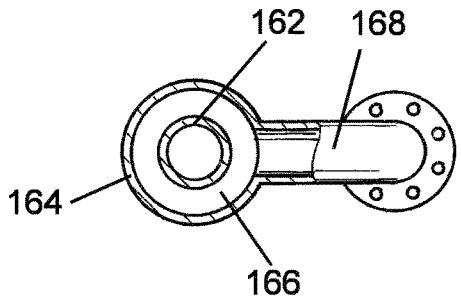
FIG. 12 is a view taken along the lines 12-12 of FIG. 11.
Figure 11:
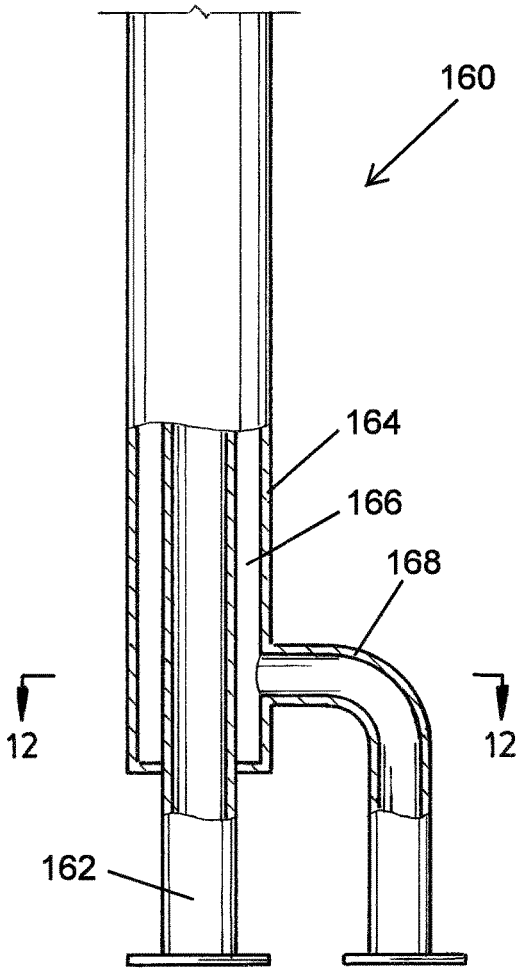
FIG. 11 is an elevational view of another embodiment of the flare gas assembly of the present invention.

Turning now to FIGS. 11 and 12, another embodiment of the present invention depicted generally as 160 is shown. In the embodiments shown in FIGS. 11 and 12, there is an air pipe or conduit 162 connected as described above to a blower or other source of air. In surrounding relationship to air pipe 162 is an outer pipe 164, an annulus 166 being formed between pipes 162 and 164. Annulus 166 receives flare gas from a pipe 168 connected to outer pipe 164. It will be appreciated that with regard to the upper ends of pipes 162 and 164, the elevation of upper end of pipe 162 is below that of outer pipe 164, as described above with respect to the other embodiments. In other words, the elevation of the air pipe or conduit 162 will be below the elevation of the outer pipe 164. Indeed, this is true of all the embodiments of the present invention in that the upper end of the air pipe is always below the upper end of the outermost pipe in order that a mixing chamber be formed above the upper open end of the air pipe and the upper end of the outermost pipe, it being understood that any intermediate pipe as shown in some of the embodiments will have an uppermost end which can be coterminous with the air pipe but which in any event will be below the upper open end of the outermost pipe. The embodiment of FIGS. 11 and 12 can be used either with high pressure or low pressure flare gas.

Figure 14:
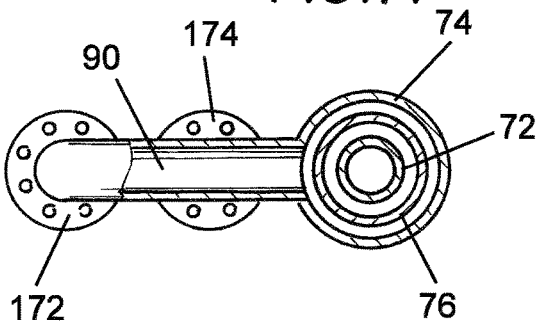
FIG. 14 is a cross-sectional view taken along the lines 14-14 of FIG. 13.
Figure 13:
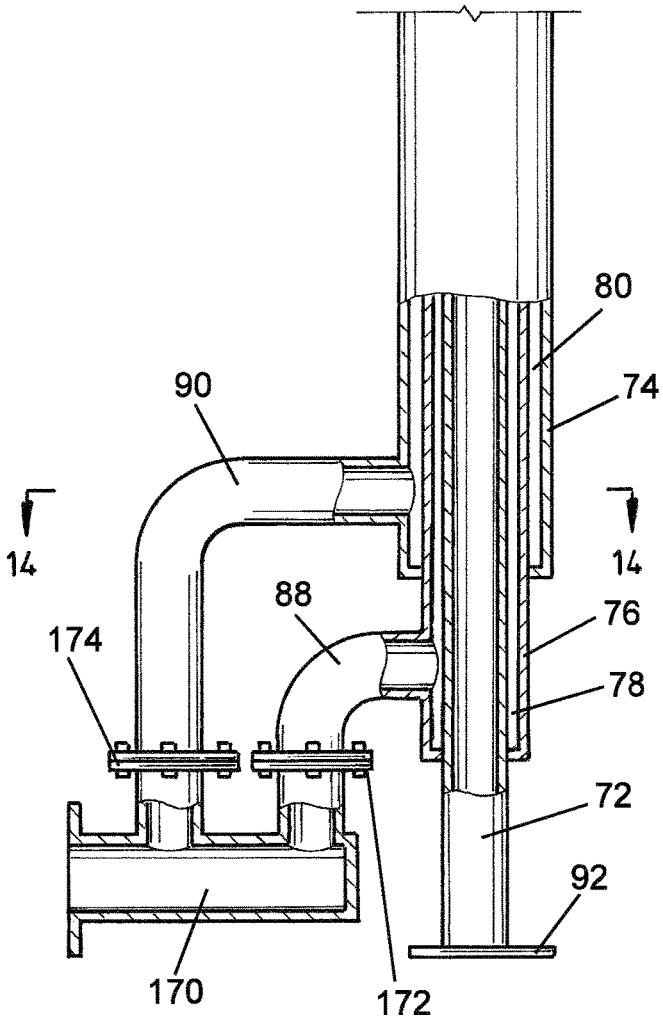
FIG. 13 is an elevational view, partly in section of another embodiment of the flare gas assembly of the present invention.

Turning now to FIGS. 13 and 14, there is shown a modification of the embodiment depicted in FIG. 5. In the embodiment shown in FIG. 5, the two flare gases, e.g., low pressure and high pressure flare gases, are introduced via pipes 88 and 90, respectively, each of the low and high pressure flare gases in pipes 88 and 90, coming from different sources. In the embodiment shown in FIGS. 13 and 14, the pipes 88 and 90 are connected to a common pipe 170 via typical flange connections 172 and 174, respectively. The embodiment depicted in FIGS. 13 and 14 is especially useful in cases where the tank batteries have a large volume of low pressure gas which needs to be vented. In the case of large volumes of high pressure gas, the plumbing arrangement shown with respect to the embodiment of FIGS. 13 and 14 is of little or no consequence because pressure drop issues do not come into play.

While the invention has been described above primarily with respect to the flaring of high pressure and low pressure flare gases, it is not so limited. For example, the flare gas assembly could be used for the venting of two sources of low pressure flare gas or two sources of high pressure flare gas. As noted above, in the case where there is a large volume of low pressure flare gas from tank batteries, or similar sources of low pressure flare gas, there could be a single input as evidence by pipe 170 in FIG. 13 of low pressure flare gas which is basically split into two flow paths up annuli 80 and 78. In certain of the embodiments described above, specific reference is made to a high pressure flare gas and a low pressure flare gas. It is to be understood that such designations are by example only and that the high pressure flare gas conduit or pipe could be used for low pressure and vice versa.

A distinct feature of the flare gas assembly of the present invention is that forced combustion air is routed up a center pipe providing a central air column while the flare gas(es) is/are introduced into 360° annular gas column(s) in surrounding relationship to the combustion air column. This configuration coupled with the mixing chamber formed at the top of the flare stack allows the flare gas to be subject to forced combustion air from the center air column and passive ambient air outside the gas air flare column. Accordingly, this unique construction means there is always a rich column of gas at the flare tip that can be easily ignited regardless of whether the gases being flared are high pressure, low pressure, or a mixture thereof. The unique construction of the flare gas assembly of the present invention ensures that even low pressure flare gas will ignite and substantially completely combust, giving a DRE of greater than 98%. In actual testing, employing the gas flare assembly substantially as shown in FIGS. 1-4, high pressure gas from a typical separator and low pressure gas from a tank battery were flared simultaneously. There was no wind shroud around the flare gas assembly. FTIR cameras detected no hydrocarbons from the emissions of the burning flare gases, meaning that the DRE was substantially 100%.

Because the blower stays at a fixed, constant speed at all times and at all flare gas flow rates, the modulation of air flow using VFD systems is eliminated. In essence, the system of the present invention eliminates the need for flow meters, VFDs, computer interfaces, and other complicated, expensive equipment, and still achieves complete combustion of both high and low pressure flare gases. In a preferred embodiment, the blowers of the present invention are also simple in that they are direct drive systems. Thus, the motor output shaft is directly coupled to the impeller/fan, meaning that the speed of the motor determines the speed of the impeller/fan. For example, a typical blower for use in the flare gas assembly of the present invention can employ a motor rotating at 1700 RPMs, meaning that the impeller/fan of the blower is also operating at 1700 RPMs. Preferred blowers for use in the present invention are centrifugal blowers which, as well known to those skilled in the art, are constant displacement or constant volume devices, meaning that at a constant rotational speed, the impeller moves a relatively constant volume of air rather than a constant mass. Accordingly, the air velocity in the system is fixed even though the mass flow rate through the fan may not be.

It is one of the features of the present invention that the system can consist essentially of a flare gas assembly as described above and a blower system comprised of a motor directly coupled to the impeller/fan blade of a centrifugal blower, whereby the speed in RPMs of the impeller is the same as the speed of the motor driving the impeller and is fixed during a flaring cycle. Depending upon the size of the flare, the volume of gas being handled, etc., speeds of 1700 to 3400 RPMs are generally suitable.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A flare gas assembly for flaring first and second flare gases comprising:

an air pipe having an upper open end;

a plenum housing in encircling relationship to said air pipe, said plenum housing forming a first flare gas chamber and a second flare gas chamber;

a first flare gas inlet into said first flare gas chamber;

a second flare gas inlet into said second flare gas chamber;

a first conduit in encircling relationship to said air pipe forming a first annular space and having a first upper open end;

a second conduit in encircling relationship to said first conduit and forming a second annular space and having a second upper open end;

said first annular space being connected to said first flare gas chamber;

said second annular space being connected to said second flare gas chamber;

said second upper open end extending above said air pipe upper open end and said first upper open end.

2. The flare gas assembly of claim 1, wherein said plenum housing is circular when viewed in top plan view.

3. The flare gas assembly of claim 1, wherein said plenum housing comprises a first upper plate, a second lower plate, and a peripheral wall interconnecting said first and second plates.

4. The flare gas assembly of claim 3, wherein said plenum housing includes an intermediate plate between said first and second plates.

5. The flare gas assembly of claim 4, wherein said first flare gas chamber is formed between said intermediate plate and said first plate, and said second flare gas chamber is formed between said intermediate plate and said second plate.

6. The flare gas assembly of claim 1, wherein the distance between the closest of said upper open end of said air pipe or said first upper open end of said first conduit to said second conduit upper open end is from about 2 to about 8 inches.

7. The flare gas assembly of claim 1, wherein said first gas inlet comprises a first pipe, and said second flare gas assembly comprises a second pipe.

8. The flare gas assembly of claim 1, comprising a single blower connected to said air pipe, said blower being operated at a constant speed to provide a constant flow rate of air to said air pipe.

9. A method of operating a flare gas assembly, wherein the assembly comprises an air pipe having an upper open end, a first conduit in encircling relationship to the air pipe and having a first conduit upper open end, a first annular space being formed between said air pipe and said first conduit, the upper open end of said first conduit extending above said upper open end of said air pipe, to form a mixing chamber, said method comprising:

introducing a flare gas into said first annular space;

introducing combustion air into said air pipe at a constant flow rate;

mixing said combustion air with said flare gas in said mixing chamber; and combusting said mixed combustion air and flare gas at a destruction and removal efficiency of greater than 98%.

10. The method of claim 9, wherein said flare gas assembly has a second conduit with a second conduit upper open end in encircling relationship to said first conduit, a second annular space being formed between first and second conduit, said second conduit upper open end extending above said upper open end of said air pipe and said first conduit upper open end, said method further comprising:

introducing a second flare gas into said second annular space.

11. The method of claim 10, wherein the distance between the closest of said upper open end of said air pipe or said first conduit upper open end to said second conduit upper open end is from about 2 to about 8 inches.

12. The method of claim 10, wherein said upper open end of said air pipe and said first conduit upper open end are coterminous and below said second conduit upper open end.

13. The method of claim 9, wherein said flare gas assembly comprises at least one blower connected to said air pipe, said blower being operated at a constant speed to provide said constant flow rate of combustion air to said air pipe.

14. A flare gas assembly for flaring first and second flare gases comprising:

an air pipe having an upper open end;

a plenum housing in encircling relationship to said air pipe, said plenum housing forming a first flare gas chamber and a second flare gas chamber;

a first flare gas inlet into said first flare gas chamber;

a second flare gas inlet into said second flare gas chamber;

a first conduit in encircling relationship to said air pipe forming a first annular space and having a first upper open end;

a second conduit in encircling relationship to said first conduit and forming a second annular space and having a second upper open end;

said first annular space being connected to said first flare gas chamber; and said second annular space being connected to said second flare gas chamber.

15. A flare gas assembly comprising:

an air pipe having an upper open end;

a first conduit in encircling relationship to said air pipe and having a first conduit upper open end, a first annular space being formed between said air pipe and said first conduit;

a second conduit in encircling relationship to said first conduit, said second conduit having a second conduit upper open end, a second annular space being formed between said first conduit and said second conduit;

said second conduit upper open end extending above said upper open end of said air pipe and said first conduit upper open end; and a blower connected to said air pipe to provide air to said air pipe at a desired flow rate.

16. The flare gas assembly of claim 15, wherein the distance between the closest of said upper open end of said air pipe or said first conduit upper open end to said second conduit upper open end is from about 2 to about 8 inches.

17. The flare gas assembly of claim 15, wherein said air pipe upper open end and said first conduit upper open end are coterminous.

18. The flare gas assembly of claim 15, wherein said first annular space is connected to a source of said first flare gas by a first gas pipe.

19. The flare gas assembly of claim 18, wherein said first gas pipe is at an angle to said first annular space.

20. The flare gas assembly of claim 18, wherein said first gas pipe is connected to said first annular space tangentially.

21. The flare gas assembly of claim 15, wherein said second annular space is connected to a source of said second flare gas by a second gas pipe.

22. The flare gas assembly of claim 21, wherein said second gas pipe is at an angle to said second annular space.

23. The flare gas assembly of claim 21, wherein said second gas pipe is connected to said second annular space tangentially.

24. The flare gas assembly of claim 21, where said first and second gas pipes are connected to a common feed pipe.

* * * * *